US009578414B2

(12) United States Patent
Goto et al.

(10) Patent No.: US 9,578,414 B2
(45) Date of Patent: Feb. 21, 2017

(54) ACTIVE NOISE-REDUCTION APPARATUS

(71) Applicant: KABUSHIKI KAISHA TOSHIBA, Minato-ku, Tokyo (JP)

(72) Inventors: Tatsuhiko Goto, Kanagawa (JP); Osamu Nishimura, Kanagawa (JP); Akihiko Enamito, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 53 days.

(21) Appl. No.: 14/630,800

(22) Filed: Feb. 25, 2015

(65) Prior Publication Data

US 2015/0172813 A1 Jun. 18, 2015

Related U.S. Application Data

(63) Continuation of application No. PCT/JP2013/074001, filed on Aug. 30, 2013.

(30) Foreign Application Priority Data

Sep. 18, 2012 (JP) ..... 2012-205013

(51) Int. Cl.
*H04R 3/00* (2006.01)
*G10K 11/178* (2006.01)

(52) U.S. Cl.
CPC ..... *H04R 3/002* (2013.01); *G10K 11/1784* (2013.01); *G10K 2210/3027* (2013.01); *G10K 2210/3045* (2013.01)

(58) Field of Classification Search
None
See application file for complete search history.

(56) References Cited

U.S. PATENT DOCUMENTS 4,490,841 A 12/1984 Chaplin et al.
5,649,018 A 7/1997 Gifford et al.
(Continued)

FOREIGN PATENT DOCUMENTS

JP 09-330088 12/1997
JP 2005-282804 10/2005
(Continued)

OTHER PUBLICATIONS

First Office Action for Japanese Patent Application No. 2012-205013 dated Mar. 31, 2015, 4 pages.
Ohta, Yuhsuke, et al.; Direct Fully Adaptive Active Noise Control Algorithms without Identitfication of Secondary Path Dynamics; Proceedings of the 2002 IEEE International Conference on Control Applications; Sep. 18-20, 2002; pp. 453-458; Glasgow, Scotland, U.K.
(Continued)

*Primary Examiner* — Brenda Bernardi
(74) *Attorney, Agent, or Firm* — Amin, Turocy & Watson LLP

(57) ABSTRACT

According to one embodiment, an active noise-reduction apparatus includes following units. The reference signal generation unit generates different reference signals based on target sound generated from a sound source. The filter processing unit generates first control signals by filtering the reference signals using first digital filters. The averaging unit generates a second control signal by averaging the first control signals. The control speaker outputs the second control signal as control sound. The error microphone detects a synthetic sound pressure of the target sound and the control sound to generate an error signal. The filter update unit updates the first digital filters so that the error signal is minimized.

9 Claims, 7 Drawing Sheets

(56) References Cited

U.S. PATENT DOCUMENTS

| | | | | |
|---|---|---|---|---|
| 8,238,575 | B2 * | 8/2012 | Buck | G10L 25/78 381/71.11 |
| 8,243,941 | B2 * | 8/2012 | Togawa | G10K 11/178 381/71.1 |
| 2007/0076896 | A1 | 4/2007 | Hosaka et al. | |
| 2008/0317254 | A1 | 12/2008 | Kano | |
| 2010/0177905 | A1 * | 7/2010 | Shridhar | G10K 11/1782 381/71.11 |
| 2015/0063581 | A1 * | 3/2015 | Tani | G10K 11/178 381/71.2 |

FOREIGN PATENT DOCUMENTS

| | | |
|---|---|---|
| JP | 2007-093962 | 4/2007 |
| JP | 2009-029405 | 2/2009 |

OTHER PUBLICATIONS

International Search Report for International Patent Application No. PCT/JP2013/074001 mailed on May 16, 2014.

Tu, Yifeng; Multiple Reference Active Noise Control; Thesis Submitted to the Faculty of the Virginia Polytechnic Institute and State University; Mar. 1997; pp. 1-99; Blacksburg, Virginia.

Kuo, Ph.D., Sen M., et al.; Design of Active Noise Control Systems With the TMS320 Family; Jun. 1996; pp. 3 and 34-35; Texas Instruments, INC., USA.

Ohta, Yuhsuke, et al.; New Direct Adaptive Approach to Multichannel Active Noise Control; Electronics and Communications i Japan; 2005; pp. 13-24; Part 3, vol. 8, No. 12; Wiley Periodicals, Inc.

International Preliminary Report on Patentability for International Patent Application No. PCT/JP2013/074001 Dated Apr. 2, 2015, 8 pages.

* cited by examiner

ACTIVE NOISE-REDUCTION APPARATUS

CROSS-REFERENCE TO RELATED APPLICATIONS

This application is a Continuation application of PCT Application No. PCT/JP2013/074001, filed Aug. 30, 2013 and based upon and claiming the benefit of priority from Japanese Patent Application No. 2012-205013, filed Sep. 18, 2012 the entire contents of all of which are incorporated herein by reference.

FIELD

Embodiments described herein relate generally to an active noise-reduction apparatus.

BACKGROUND

As a basic method of active noise control (ANC), a method called "Filtered-x" is known. However, Filtered-x requires identification of spatial characteristics between a control speaker and an error microphone in advance (i.e., secondary path identification), and cannot be used when environmental characteristics change or when an apparatus cannot be fixed.

Also, an ANC method called a direct method which does not require secondary path identification in advance is known. However, with the direct method, when a reference signal changes abruptly at the time of generation of noise, an input to a control speaker increases transiently, and noise is increased conversely, resulting in unstable control. On the other hand, when parameters (step sizes) for controlling coefficient update amounts of adaptive filters are adjusted to prevent such increase in input, convergence of the adaptive filters requires much time.

As described above, the control stability and the convergence speed of the adaptive filter have a trade-off relationship. For this reason, it is difficult to improve noise reduction efficiency. Therefore, an active noise-reduction apparatus is required to efficiently reduce noise.

DETAILED DESCRIPTION

In general, according to one embodiment, an active noise-reduction apparatus includes a reference signal generation unit, a first filter processing unit, an averaging unit, a control speaker, an error microphone, and a filter update unit. The reference signal generation unit is configured to generate a plurality of reference signals based on target sound generated from a sound source. The first filter processing unit is configured to generate a plurality of first control signals by filtering the plurality of reference signals using a plurality of first digital filters. The averaging unit is configured to generate a second control signal by averaging the plurality of first control signals. The control speaker is configured to output the second control signal as control sound. The error microphone is configured to detect a synthetic sound pressure of the target sound and the control sound, and to generate an error signal indicating the detected synthetic sound pressure. The filter update unit is configured to update the plurality of first digital filters so that the error signal is minimized.

Hereinafter, various embodiments will be described with reference to the accompanying drawings. In the embodiments, like reference numbers denote like elements, and a repetitive description thereof will be avoided.

First Embodiment

Figure 1:
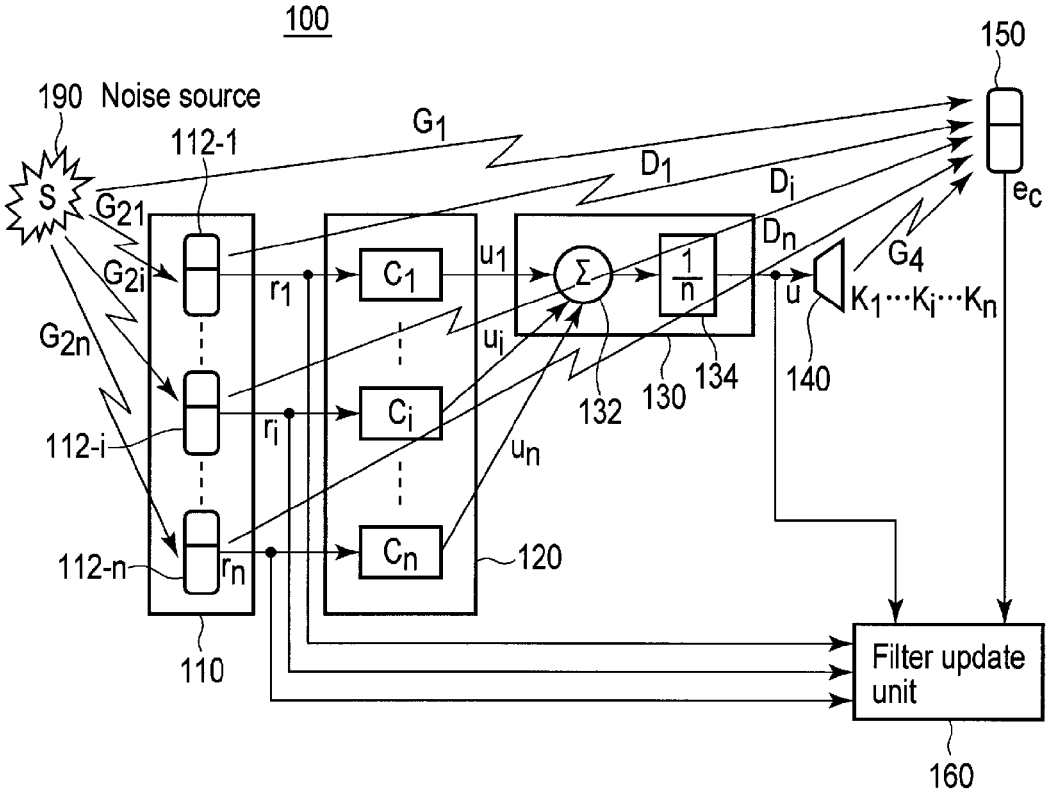
FIG. 1 is a block diagram schematically showing an active noise-reduction apparatus according to the first embodiment.

FIG. 1 schematically shows an active noise-reduction apparatus 100 according to the first embodiment. As shown in FIG. 1, the active noise-reduction apparatus 100 includes a reference signal generation unit 110, filter processing unit 120, averaging unit 130, control speaker 140, error microphone 150, and filter update unit 160.

The reference signal generation unit 110 generates a plurality of (n) reference signals $r_1$ to $r_n$ based on noise generated or emitted from a noise source 190, where n is an integer not less than 2. In this embodiment, the reference signal generation unit 110 includes a plurality of (n) reference microphones 112-1 to **112-*n* which are disposed at different positions, and these reference microphones 112-1 to 112-*n* detect a sound pressure of noise from the noise source 190** to generate detection signals, and output the detection signals as the reference signals $r_1$ to $r_n$.

The filter processing unit 120 generates first control signals $u_1$ to $u_n$ by filtering the reference signals $r_1$ to $r_n$ using digital filters $C_1$ to $C_n$. Digital filters $C_1$ to $C_n$ are provided in correspondence with the reference microphones 112-1 to **112-*n*, respectively. For example, a digital filter $C_i$ is used to generate a first control signal $u_i$ from a reference signal $r_i$ acquired by a reference microphone 112-*i*, where i is an integer such that $1 \le i \le n$. The averaging unit 130 generates a second control signal (to be also referred to as a control input) u by arithmetically averaging the first control signals $u_1$ to $u_n$. More specifically, the averaging unit 130 includes an adder 132 which adds the first control signals $u_1$ to $u_n$, and a multiplier 134 which multiplies the output signal from the adder 132** by 1/n.

The control speaker 140 converts the second control signal u into sound. The sound produced by the control speaker 140 will be referred to as control sound hereinafter. The error microphone 150 detects a synthetic sound pressure of noise from the noise source 190 and the control sound from the control speaker 140, and generates an error signal $e_c$ indicating the detected synthetic sound pressure. The filter update unit 160 updates digital filters $C_1$ to $C_n$ so that the error signal $e_c$ is minimized.

The active noise-reduction apparatus 100 of this embodiment controls noise from the noise source 190 by the control sound from the control speaker 140 so that a sound pressure of noise from the noise source 190 at the setting position of the error microphone 150 is minimized. Sound to be controlled, which is generated from a certain sound source like noise generated by the noise source 190, will also be referred to as target sound.

Processing for updating digital filters $C_1$ to $C_n$ by the filter update unit 160 will be described below with reference to FIGS. 1 and 2.

Figure 2:
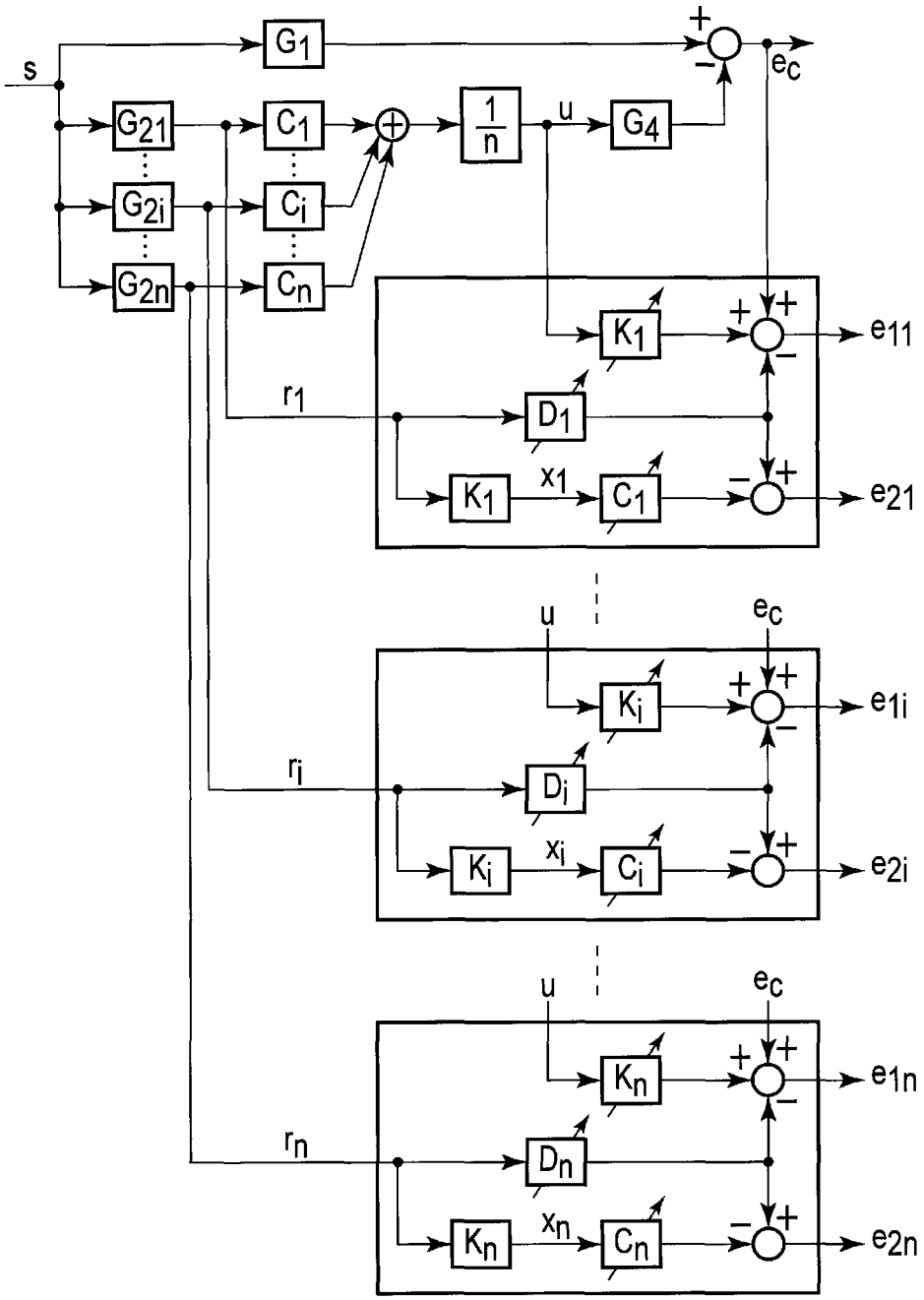
FIG. 2 is a view for explaining an ANC method according to the first embodiment.

As shown in FIG. 2, the filter update unit 160 generates 2n virtual error signals $e_{11}$ to $e_{1n}$ and $e_{21}$ to $e_{2n}$ based on digital filters $C_1$ to $C_n$, digital filters $K_1$ to $K_n$, digital filters $D_1$ to $D_n$, the reference signals $r_1$ to $r_n$, the control signal u, and the error signal $e_c$. Digital filters $K_1$ to $K_n$ are respectively provided in correspondence with the reference microphones 112-1 to **112-*n*, and identify spatial characteristics between the control speaker 140 and error microphone 150 respectively in association with the reference microphones 112-1 to 112-*n*. Digital filters $D_1$ to $D_n$ are respectively provided in correspondence with the reference microphones 112-1 to 112-*n*, and identify spatial characteristics between the reference microphones 112-1 to 112-*n* and error microphone 150, respectively. For example, virtual error signals $e_{1i}$ and $e_{2i}$ are calculated based on digital filters $C_i$, $K_i$, and $D_i$, a reference signal $r_i$, the control signal u, and the error signal $e_c$. As will be described later, the filter update unit 160** updates digital filters $C_1$ to $C_n$, $K_1$ to $K_n$, and $D_1$ to $D_n$ (more specifically, filter coefficients of digital filters $C_1$ to $C_n$, $K_1$ to $K_n$, and $D_1$ to $D_n$) so that each of virtual error signals $e_{11}$ to $e_{1n}$ and $e_{21}$ to $e_{2n}$ is minimized and so that each of digital filters $K_1$ to $K_n$ converges on an identical digital filter. Thus, the error signal $e_c$ can be minimized.

Various signals and transfer functions will be defined first. Let s(k) be noise generated by the noise source 190, $r_i(k)$ be a reference signal acquired by a reference microphone **112-*i*, and $e_c(k)$ be an error signal acquired by the error microphone 150, where k is time. Furthermore, let $G_{2i}(z)$ be a transfer function from the noise source 190 to the reference microphone 112-*i*, $G_4(z)$ be a transfer function from the control speaker 140 to the error microphone 150, and $G_1(z)$ be a transfer function from the noise source 190 to the error microphone 150. Let $C_i(z, k)$, $K_i(z, k)$, and $D_i(z, k)$ be adaptive filters corresponding to the reference microphone 112-*i*, and $\theta_{Ci}$, $\theta_{Ki}$, and $\theta_{Di}$ be their finite impulse response (FIR) expressions. Let $e_{1i}(k)$ and $e_{2i}(k)$ be virtual error signals corresponding to the reference microphone 112-*i***. Let $u_i(k)$ be a first control signal obtained by filtering the reference signal $r_i(k)$ using the filter $C_i(z, k)$. Let u(k) be a second control signal obtained by averaging first control signals $u_1(k)$ to $u_n(k)$. Let $x_i(k)$ be an auxiliary signal obtained by filtering the reference signal $r_i(k)$ using the filter $K_i(z, k)$. Let $\phi_1(k)$ and $\xi_i(k)$ be time-series vectors of the auxiliary signal $x_i(k)$ and reference signal $r_i(k)$, respectively. Let $\zeta(k)$ be a time-series vector of the second control signal u(k).

A merit of use of the plurality of reference microphones will be described below. In the direct method, a secondary path (more specifically, transfer characteristics of a path from a control speaker to an error microphone) is estimated based on a reference signal acquired by one reference microphone and an error signal acquired by one error microphone. However, in a transient stage in which a reference signal changes abruptly like a noise generation initial stage, information amounts obtained from the reference signal and error signal are small, and there are a large number of combinations of filters $\theta_D$, $\theta_K$, and $\theta_C$ which make the error signal be zero. This causes estimation errors of the secondary path in the transient stage. As a result, noise is increased when an input (control input) to the control speaker is transiently increased, resulting in unstable control. On the other hand, when step sizes are reduced to suppress an increase in control input, the convergence speed of adaptive filters lowers.

With the active noise control (ANC) method using the plurality of reference microphones according to this embodiment, since the plurality of reference signals can be obtained from the plurality of reference microphones, information amounts increase in the transient stage. Thus, since the number of combinations of filters $\theta_D$, $\theta_K$, and $\theta_C$ which make the error signal be zero is reduced, estimation errors of the secondary path are reduced in comparison with the direct method. That is, the estimation precision of the secondary path is improved. Since the estimation precision of the secondary path is improved, control becomes stable, and large step sizes can be set accordingly. As a result, the convergence speed of adaptive filters can be increased (that is, a control effect speed is increased), and stability of the control can be enhanced.

The ANC method according to this embodiment will be described in detail below. Update rules of adaptive filters used in the ANC method according to this embodiment are expressed, in association with the reference microphone **112-*i***, by:

$$\theta_{D_i}(k+1) = \theta_{D_i}(k) + \frac{2\alpha_{D_i}}{\beta_{D_i} + \|\xi_i(k)\|^2}\xi_i(k)[e_{1i}(k) - e_{2i}(k)] \tag{1}$$

$$\theta_{K_i}(k+1) = \theta_{K_i}(k) - \frac{2\alpha_{K_i}}{\beta_{K_i} + \|\zeta_i(k)\|^2}\zeta(k)e_{1i}(k) + \frac{\alpha}{n}\sum_{j\neq i}\left(\theta_{K_j}(k) - \theta_{K_i}(k)\right) \tag{2}$$

$$\theta_{C_i}(k+1) = \theta_{C_i}(k) + \frac{2\alpha_{C_i}}{\beta_{C_i} + \|\phi_i(k)\|^2}\phi_i(k)e_{2i}(k) \tag{3}$$

The third term of equation (2) is a term to be updated in cooperation with other reference microphones, and is called a consensus term. $\alpha$ is a weighting factor for the consensus term. The weighting factor $\alpha$ is a parameter for adjusting the cooperative or interactive strength among the reference microphones 112-1 to **112-*n***.

The update rules used in the ANC method according to this embodiment correspond to those obtained by adding the consensus term to the update rules of the direct method. The direct method adopts update rules called least mean square (LMS) as those based on the steepest descent method. For the sake of comparison, the update rules of the direct method are expressed by:

$$\theta_D(k+1) = \theta_D(k) + \frac{2\alpha_D}{\beta_D + \|\xi(k)\|^2}\xi(k)[e_1(k) - e_2(k)] \tag{4}$$

$$\theta_K(k+1) = \theta_K(k) - \frac{2\alpha_K}{\beta_K + \|\zeta(k)\|^2}\zeta(k)e_1(k) \tag{5}$$

$$\theta_C(k+1) = \theta_C(k) + \frac{2\alpha_C}{\beta_C + \|\phi(k)\|^2}\phi(k)e_2(k) \tag{6}$$

When the update rules of the direct method are simply applied to the active noise-reduction apparatus 100 of this embodiment, different identification results of the secondary path are obtained respectively for the reference microphones 112-1 to **112-*n***. As a result, the secondary path identification precision cannot be improved. Furthermore, convergence conditions of the update rules are no longer satisfied. Since the ANC method according to this embodiment uses the update rules added with the consensus term, the same identification result of the secondary path can be obtained.

Convergence characteristics when the update rules (equations (1), (2), and (3)) of this embodiment are used will be described below.

Referring to FIG. 2, two virtual error signals $e_{1i}(k)$ and $e_{2i}(k)$ corresponding to the reference microphone **112-*i*** are expressed by:

$$e_{1i}(k)=e_c(k)+K_i(z,k)u(k)-D_i(z,k)r_i(k) \tag{7}$$

$$e_{2i}(k)=D_i(z,k)r_i(k)-C_i(z,k)x_i(k) \tag{8}$$

The auxiliary signal $x_i(k)$ in equation (8) is expressed by:

$$x_i(k)=K_i(z,k-l_k)r_i(k) \tag{9}$$

wherein $l_k$ means use of a filter $K_i$ several steps before.

From equations (7), (8), and (9), the sum of virtual error signals $e_{1i}(k)$ and $e_{2i}(k)$ associated with the reference microphone **112-*i*** is derived as:

$$e_{1i}(k)+e_{2i}(k)=e_c(k)+K_i(z,k)u(k)-C_i(z,k)K_i(z,k-l_k)r_i(k) \tag{10}$$

In this case, the second control signal u(k) supplied to the control speaker 140 is expressed by:

$$u(k) = \frac{1}{n}\sum_{i=1}^{n} C_i(z, k - l_c)r_i(k) \tag{11}$$

wherein $l_c$ means use of a filter $C_i$ several steps before.

The sum of virtual error signals associated with all the reference microphones 112-1 to **112-*i*** is expressed by:

$$\sum_{i=1}^{n}(e_{1i}(k) + e_{2i}(k)) = ne_c(k) + \sum_{i=1}^{n}\left(K_i(z, k)\frac{1}{n}\sum_{j=1}^{n}(C_j(z, k - l_c)r_j(k)) - C_i(z, k)K_i(z, k - l_k)r_i(k)\right) \tag{12}$$

Assuming that the estimation results of the secondary path match for respective reference microphones, that is, assuming that these results satisfy:

$$K_i(z,k)=K(z,k)\forall i \tag{13}$$

equation (12) becomes:

$$\sum_{i=1}^{n}(e_{1i}(k) + e_{2i}(k)) = ne_c(k) + \sum_{j=1}^{n}(C_j(z, k - l_c)r_j(k))K(z, k) - \sum_{i=1}^{n}(C_i(z, k)r_i(k))K(z, k - l_k) \tag{14}$$

As can be seen from equation (14), the error signal $e_c$ converges to zero by updating adaptive filters so as to satisfy the following three conditions.

The first condition is that virtual error signals $e_{1i}$ and $e_{2i}$ corresponding to the reference microphone **112-*i*** converge to zero.

The second condition is that the filters $K_i$ and $C_i$ converge.

The third condition is that equation (13) is satisfied.

The ANC method according to this embodiment corresponds to that designed by adding the third condition to convergence conditions of the direct method. The third condition means that the secondary path is equal for all the reference microphones 112-1 to **112-*n*. In this embodiment, since the transfer characteristics of the path from the control speaker to the error microphone are equal in association with all the reference microphones 112-1 to 112-*n***, the third condition is a rational condition in terms of the system arrangement.

The first and second conditions are satisfied using LMS-based update rules (equations (4), (5), and (6)) like in the direct method. However, when the LMS-based update rules are simply used, the third condition is not satisfied. In this embodiment, in order to satisfy the third condition, the consensus term is added to the update rule of the filter $K_i(z, k)$, as described by equation (2). Although only a gradient term, which is the second term of equation (2), updates in a direction to lower evaluation functions associated with respective reference microphones, when the consensus term is added, this method updates in a direction to cooperate with other reference microphones while lowering the evaluation functions associated with respective reference microphones. Thus, the third condition is finally satisfied. An evaluation function $J_i$ associated with the reference microphone **112-*i* relates to virtual error signals $e_{1i}$ and $e_{2i}$ corresponding to the reference microphone 112-*i***, and is defined, for example, by:

$$J_i=e_{1i}^2+e_{2i}^2 \tag{15}$$

The weighting factor $\alpha$ in equation (2) is a parameter for adjusting the cooperative strength among the reference microphones 112-1 to **112-*n*, as described above. When the weighting factor $\alpha$ is increased in equation (2), the cooperative strength among the reference microphones 112-1 to 112-*n* is increased. This is equivalent that a degree of convergence of digital filters $K_1$ to $K_n$ on an identical digital filter is increased to reduce a degree of minimization of the evaluation functions associated with the respective reference microphones, as given by equation (15). Conversely, when the weighting factor $\alpha$ is decreased, that is, when the cooperative strength among the reference microphones 112-1 to 112-*n*** is reduced, the degree of convergence of digital filters $K_1$ to $K_n$ on an identical digital filter is reduced, and the degree of minimization of the evaluation functions associated with the respective reference microphones is increased. Therefore, by changing the weighting factor $\alpha$, priority levels of the degree of minimization of the evaluation functions associated with the respective reference microphones and the degree of convergence of digital filters $K_1$ to $K_n$ on an identical digital filter can be adjusted.

The filter update unit 160 can adjust the weighting factor $\alpha$ during noise control. In one example, since each reference microphone holds only information of an initial filter in a noise generation initial stage, the filter update unit 160 sets a small value $\alpha$ to some extent (for example, 0.5) so as to positively execute filter update processing. After the update processing is progressed to some extent, the filter update unit 160 gradually increases the value of $\alpha$ up to 1 so as to positively cooperate with other reference microphones. In another example, the weighting factor $\alpha$ can be a fixed value.

When the update rule of the filter $C_i$ is changed from equation (3) to:

$$\theta_{C_i}(k+1) = \theta_{C_i}(k) + \frac{2\alpha_{C_i}}{\beta_{C_i} + \|\phi_i(k)\|^2}\phi_i(k)e_{2i}(k) + 2\alpha_2(u-u_i)\xi_i/(\beta + \|\xi_i\|^2) \tag{16}$$

an increase in control input in the transient stage can be suppressed more. When the update rule of the filter $C_i$ is changed to equation (16), an LMS evaluation function is changed from:

$$J=\Sigma(e_{1i}^2+e_{2i}^2) \tag{17}$$

to:

$$J=\Sigma(e_{1i}^2+e_{2i}^2)+\alpha_2\Sigma(u-u_i)^2 \tag{18}$$

As a result, the first control signal $u_i(k)$ output from each reference microphone can be prevented from being extremely separated from the second control signal (control input) u(k), thus suppressing an increase in control input in the transient stage. $\alpha_2$ is a weighting factor for adjusting a difference between the first control signal $u_i(k)$ and second control signal u(k). More specifically, when the weighting factor $\alpha 2$ is increased, the filter update unit 160 updates the adaptive filter $C_i$ so as to reduce the difference between the first control signal $u_i(k)$ and second control signal u(k).

As described above, since the ANC method according to this embodiment uses the plurality of reference microphones, information amounts to be obtained increase. In addition to the increased information amount, since the secondary path ($G_4$) to be identified is the same in association with the plurality of reference microphones, the identification precision of the secondary path can be improved. Furthermore, although the reference signals acquired by the reference microphones generally include observation noise, the influence of observation noise is suppressed by the cooperation (consensus term in equation (2)) among the plurality of reference microphones. With the ANC method using the direct method, it is known that control effects vary depending on the location of a reference microphone. However, with the ANC method according to this embodiment, the control effect corresponding to a reference microphone of the best location of the plurality of reference microphones can be obtained. Moreover, since the secondary path can be precisely identified, other path characteristics ($G_1/G_2$, $G_1(G_2G_4)$) required upon execution of ANC can be identified using more accurate information, and convergence of adaptive filters can be quickened as the whole system. That is, the control effects are more quickened.

Figure 3:
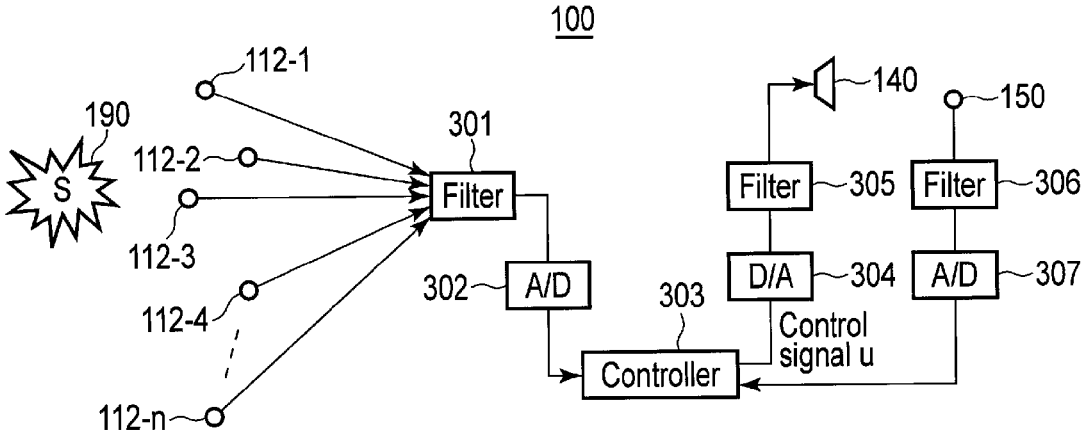
FIG. 3 is a block diagram schematically showing an example of the system arrangement of the active noise-reduction apparatus shown in FIG. 1.

FIG. 3 exemplifies the system arrangement which implements the active noise-reduction apparatus 100 shown in FIG. 1. As shown in FIG. 3, the active noise-reduction apparatus 100 includes the n reference microphones 112-1 to **112-*n*. The reference signals $r_1$ to $r_n$ acquired by the reference microphones 112-1 to 112-*n* pass through a filter 301, and are converted into digital signals by an analog-to-digital converter 302. The filter 301 is provided to take an antialiasing measure and to adjust a control band. Letting t [s] be a control signal calculation period of a controller 303, a signal to be supplied to the controller 303 has to be 1/(2t) [Hz] or lower so as not to cause aliasing. The filter 301** functions as a low-pass filter.

The reference signals $r_1$ to $r_n$ converted into digital signals are supplied to the controller 303. The controller 303 implements the filter processing unit 120, averaging unit 130, and filter update unit 160 shown in FIG. 1, and can be implemented by, for example, a personal computer (PC), integrated circuit, digital signal processor (DSP), or the like.

The control signal u generated by the controller 303 is converted into an analog signal by a digital-to-analog converter 304, passes through a filter 305, and is supplied to the control speaker 140. The filter 305 is provided to protect the control speaker 140. A frequency band that can be output is decided for each speaker, and when a signal of other frequency is input, the speaker may be damaged. The filter 305 removes signal components which cannot be output by the control speaker 140 from the control signal u so as to prevent the control speaker 140 from being damaged.

The error signal $e_c$ acquired by the error microphone 150 passes through a filter 306, and is converted into a digital signal by an analog-to-digital converter 307. The filter 306 is provided to take an antialiasing measure and to adjust a control band as in the filter 301. The filter 306 can adjust the control band since it serves as a role of a pre-filter in an identification theory.

As described above, according to the active noise-reduction apparatus of the first embodiment, since the plurality of reference microphones which generate reference signals based on noise (target sound) are included, information amounts to be obtained increase, and the secondary path can be precisely identified. Furthermore, since the secondary path can be precisely identified, convergence of adaptive filters is quickened. That is, noise can be efficiently reduced.

Second Embodiment

The first embodiment uses the plurality of reference microphones, while the second embodiment uses one reference microphone. In the second embodiment, differences from the first embodiment will be mainly described, and a repetitive description will be avoided.

Figure 4:
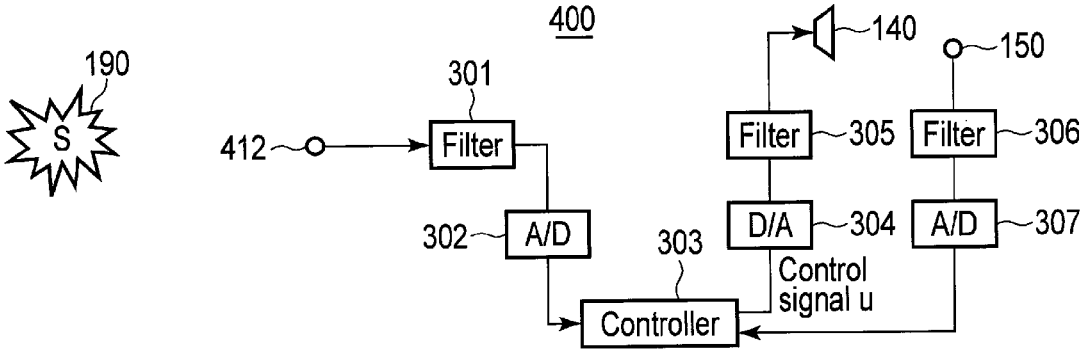
FIG. 4 is a block diagram schematically showing an example of the system arrangement of an active noise-reduction apparatus according to the second embodiment.

FIG. 4 schematically shows the system arrangement of an active noise-reduction apparatus 400 according to the second embodiment. As shown in FIG. 4, the active noise-reduction apparatus 400 includes a reference microphone 412 which detects a sound pressure of noise generated from a noise source 190 to generate a detection signal, and outputs the detection signal. The active noise-reduction apparatus 400 shown in FIG. 4 has the same arrangement as the active noise-reduction apparatus 100 (shown in FIGS. 1 and 3) according to the first embodiment, except for a reference signal generation unit.

Figure 5A:
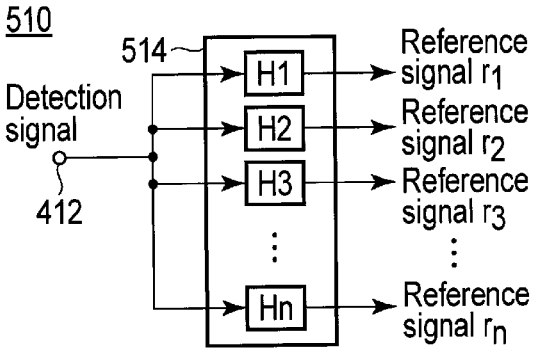
FIG. 5A is a block diagram showing an example of a reference signal generation unit according to the second embodiment.
Figure 5B:
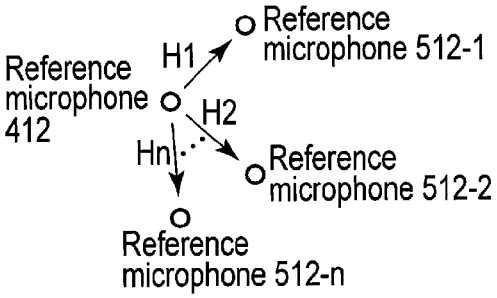
FIG. 5B is a view showing reference microphones virtually generated by the reference signal generation unit shown in FIG. 5A.

FIG. 5A shows an example 510 of a reference signal generation unit according to this embodiment, and FIG. 5B shows a plurality of virtual reference microphones 512-1 to **512-*n* generated by the reference signal generation unit 510. As shown in FIG. 5A, the reference signal generation unit 510 includes a reference microphone 412 and a filter processing unit 514. The filter processing unit 514 generates a plurality of reference signals $r_1$ to $r_n$ by convoluting spatial characteristic filters $H_1$ to $H_n$ into a detection signal output from the reference microphone 412, where n is an integer not less than 2. As shown in FIG. 5B, the filter processing unit 514 virtually generates the plurality of reference microphones 512-1 to 512-*n* located at different positions. The spatial characteristic filters $H_1$ to $H_n$ respectively indicate spatial characteristics from the reference microphone 412 to the virtual reference microphones 512-1 to 512-*n*. The reference signal generation unit 510 can implement the same functions as those of a reference signal generation unit including a plurality of reference microphones (for example, the reference signal generation unit 110 shown in FIG. 1) since it generates a plurality of reference signals from the detection signal acquired by the single reference microphone 412**.

Figure 6A:
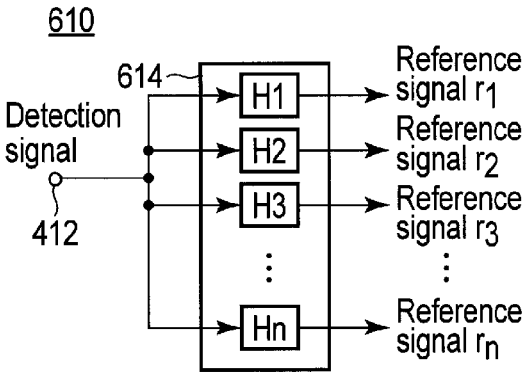
FIG. 6A is a block diagram showing another example of a reference signal generation unit according to the second embodiment.
Figure 6B:
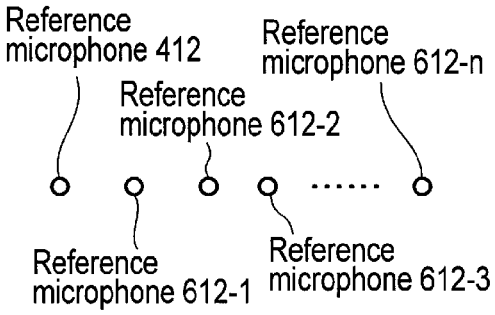
FIG. 6B is a view showing reference microphones virtually generated by the reference signal generation unit shown in FIG. 6A.

FIG. 6A shows another example 610 of a reference signal generation unit according to this embodiment, and FIG. 6B shows a plurality of virtual reference microphones 612-1 to **612-*n* generated by the reference signal generation unit 610. As shown in FIG. 6A, the reference signal generation unit 610 includes a reference microphone 412 and a filter processing unit 614. The filter processing unit 614 generates a plurality of reference signals $r_1$ to $r_n$ by filtering the detection signal output from this reference microphone 412 by delay filters $H_1$ to $H_n$. The reference signals $r_1$ to $r_n$ are generated by delaying the detection signal of the reference microphone by different delay times. For example, the filter processing unit 614 virtually generates the plurality of reference microphones 612-1 to 612-*n*, which are arranged in line along a propagation direction of noise, as shown in FIG. 6B. The reference signal generation unit 610** can also implement the same functions as those of the reference signal generation unit including the plurality of reference microphones.

Note that one (for example, the reference signal $r_1$) of the reference signals generated by the filter processing unit 514 or 614 may be the detection signal itself acquired by the reference microphone 412. That is, the reference signal generation unit is configured by the actually located reference microphone 412 and n−1 virtually generated reference microphones. The filter processing units 514 and 614 can be implemented by, for example, the controller 303.

As described above, according to the active noise-reduction apparatus of the second embodiment, since the plurality of reference signals are generated from the detection signal acquired by the single reference microphone, the same effects as in the first embodiment which includes the plurality of reference microphones can be achieved.

Figure 7A:
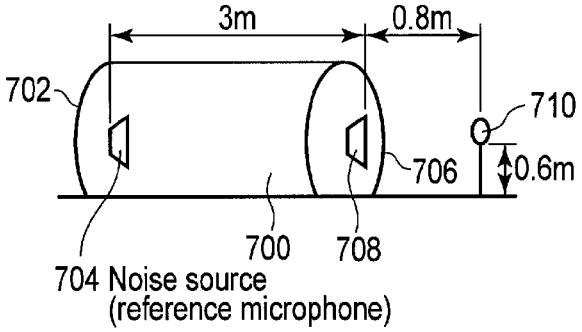
FIGS. 7A and 7B are schematic views showing an experimental design used to verify control effects of the ANC method according to the embodiment.
Figure 7B:
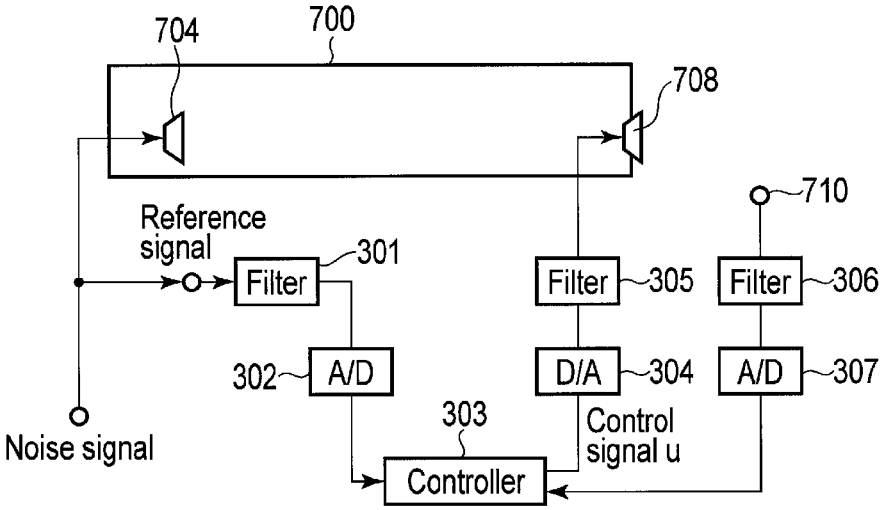

Next, the results of experiments to verify the effects of the aforementioned embodiment will be described. FIGS. 7A and 7B show an experimental design to verify the control effects of the ANC method according to the embodiment. As shown in FIG. 7A, a noise speaker (noise source) 704 for generating noise is arranged at a closed end 702 of a duct 700, and a control speaker 708 is arranged at its opening end 706. The duct 700 has an approximately cylindrical shape, and its length is 3 meters. An error microphone 710 is located at a position which has a distance of 0.8 meters from the opening end 706 and a height of 0.6 meters from a floor. In an experiment, in order to remove the influence of sound from the control speaker 708 to the reference microphone, and that of spatial coherence from the noise source 704 to the reference microphone, a noise signal to be supplied to the noise speaker 704 is used as a reference signal, as shown in FIG. 7B. Also, assume that two reference microphones are virtually arranged by the method described in the second embodiment, and reference signals output from these virtual reference microphones are respectively time-delayed by 6 taps and 12 taps from the original reference signal. That is, the number of reference signals used in this experiment is 3.

Figure 8A:
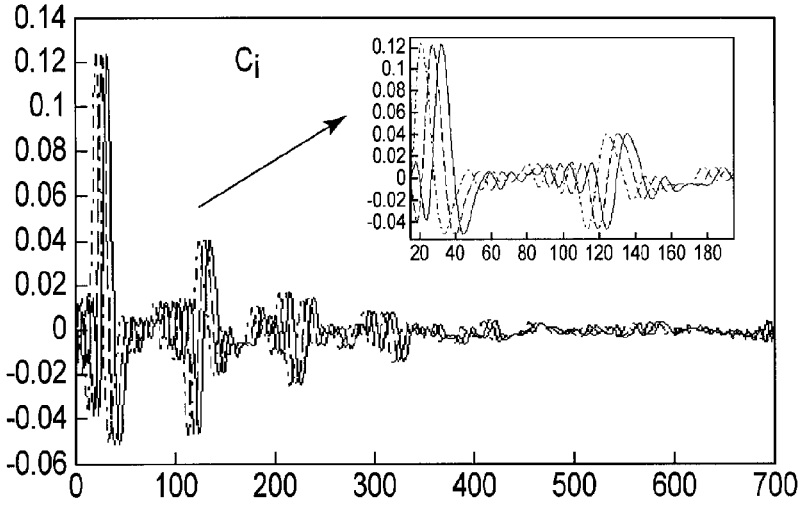
FIGS. 8A, 8B, and 8C are graphs showing experimentally obtained convergence characteristics of digital filters C, D, and K, respectively.
Figure 8B:
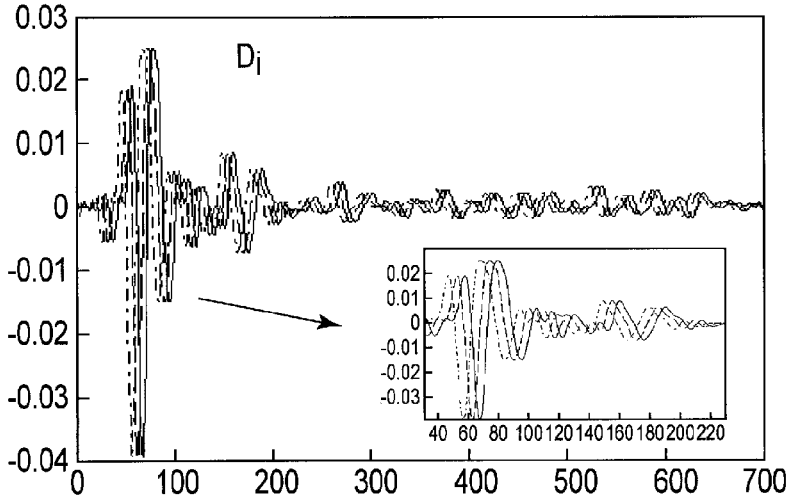
Figure 8C:
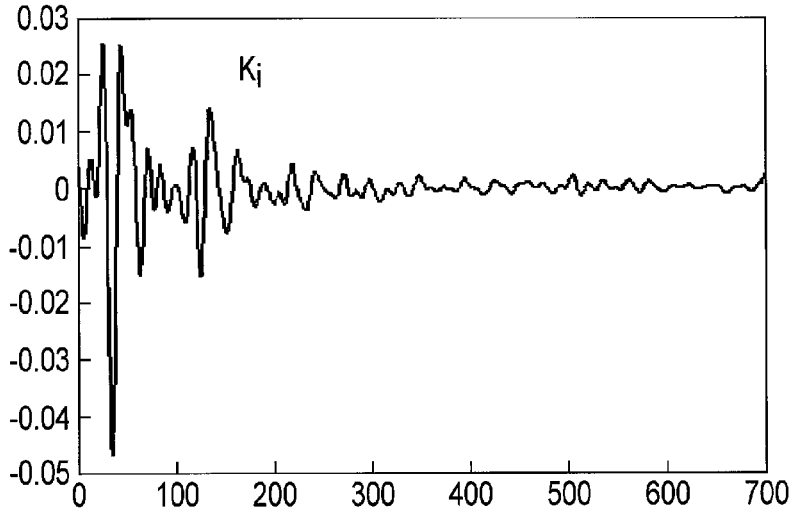

FIGS. 8A to 10C show execution results of the experiment shown in FIGS. 7A and 7B. FIGS. 8A, 8B, and 8C respectively show shapes of adaptive filters $C_i$, $D_i$, and $K_i$ (where $i=\{1, 2, 3\}$). In FIGS. 8A and 8B, waveforms are partially extracted for the purpose of clear explanation. As can be seen from FIG. 8A, virtually set tap interval differences are generated among adaptive filters $C_1$, $C_2$, and $C_3$. Also, as can be seen from FIG. 8B, virtually set tap interval differences are generated among adaptive filters $D_1$, $D_2$, and $D_3$. As can be seen from FIG. 8C, adaptive filters $K_1$, $K_2$, and $K_3$ are matched with each other. As can be understood from FIGS. 8A, 8B, and 8C, the consensus term in equation (2) works well.

Figure 9A:
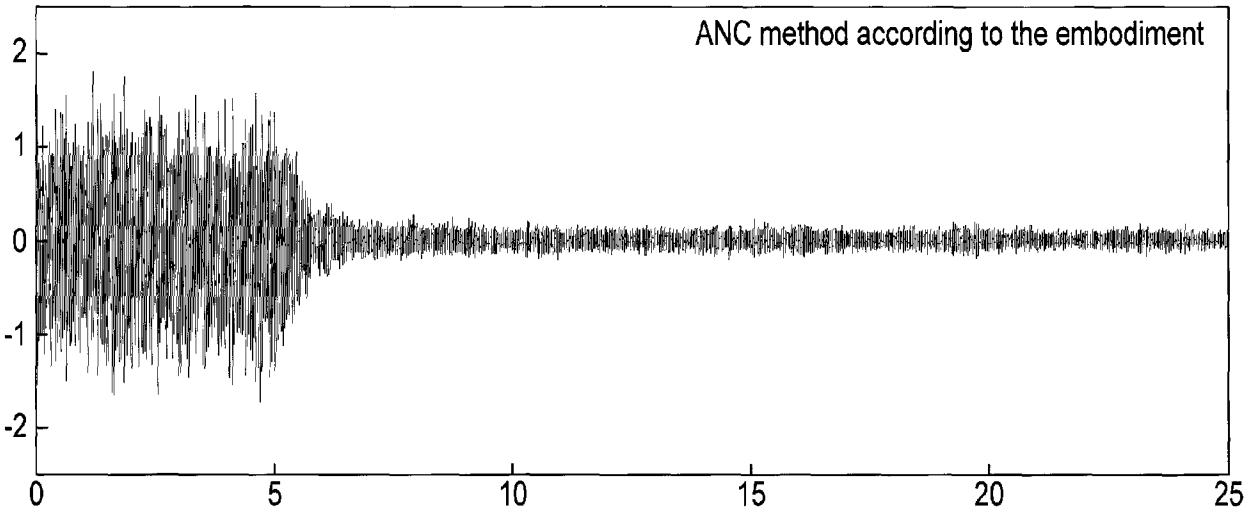
FIG. 9A is a graph showing time-series data of signal levels of an error signal obtained when the ANC method according to the embodiment is used.
Figure 9B:
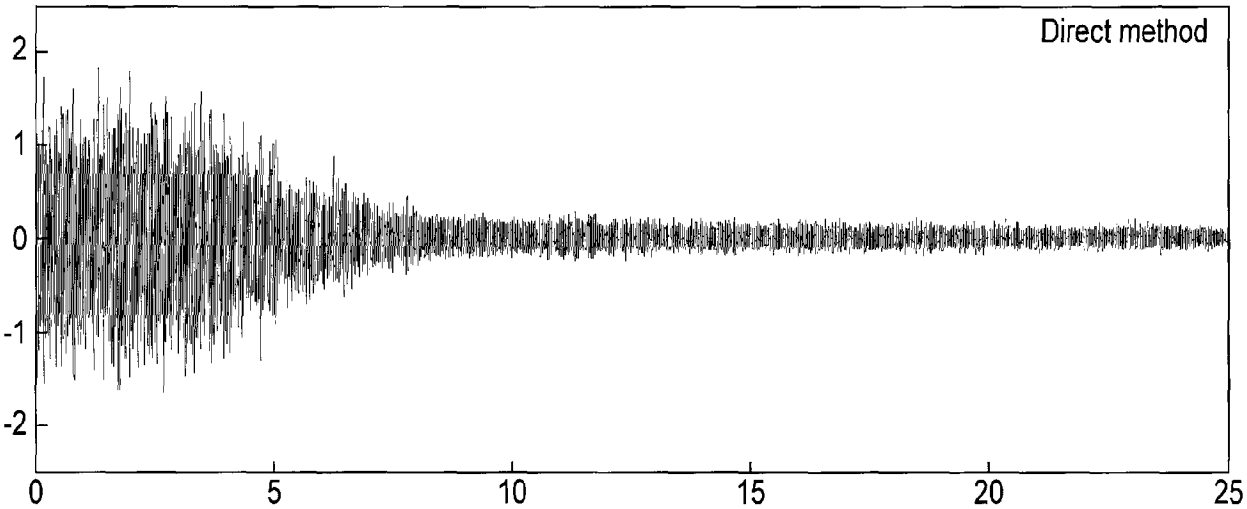
FIG. 9B is a graph showing time-series data of signal levels of an error signal obtained when the direct method is used.
Figure 10A:
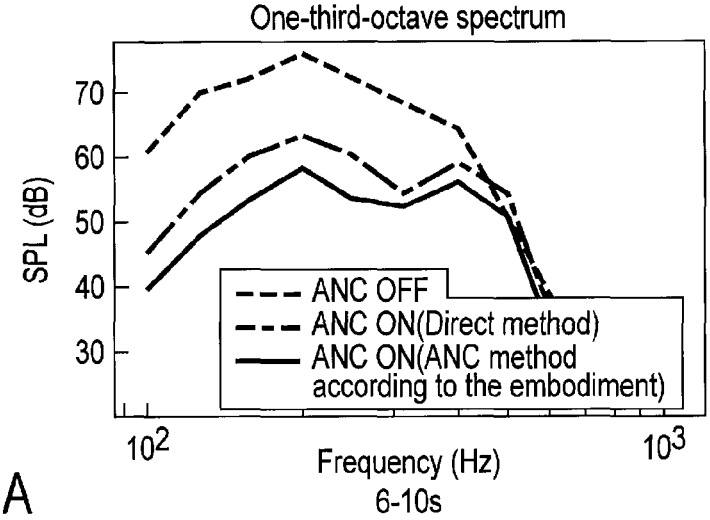
FIGS. 10A, 10B, and 10C are graphs showing comparison of control effects between the ANC method according to the embodiment and direct method in different time zones.
Figure 10B:
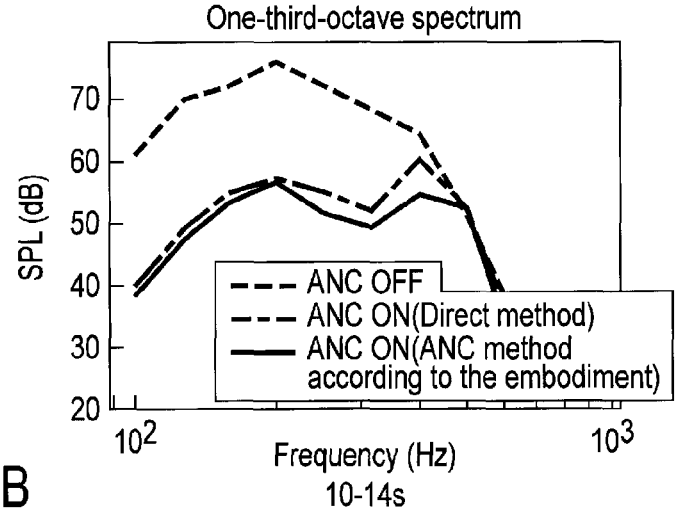
Figure 10C:
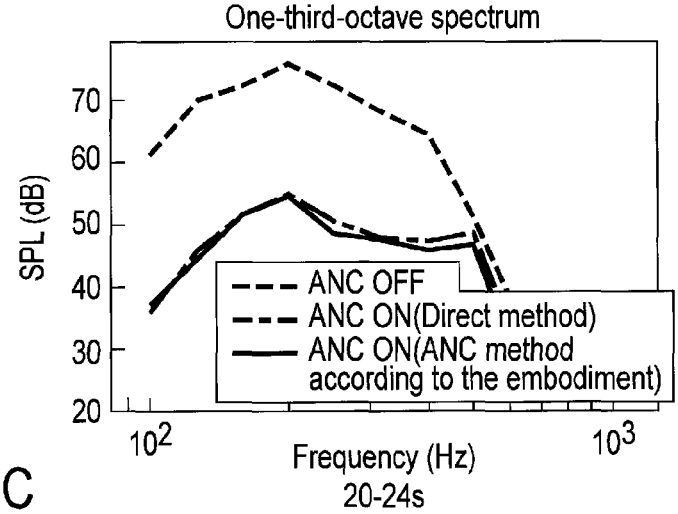

FIG. 9A shows time-series data of signal levels of an error signal obtained when the ANC method according to this embodiment is used, and FIG. 9B shows time-series data of signal levels of an error signal obtained when the direct method is used. However, this signal level is not a sound pressure but a voltage output value of a noise meter. As can be seen from FIGS. 9A and 9B, signal levels converge more quickly by the ANC method according to this embodiment. FIGS. 10A, 10B, and 10C show control effects in ⅓ octave bands during intervals of 6 to 10 s, 10 to 14 s, and 20 to 24 s. In FIGS. 10A, 10B, and 10C, sound pressure levels obtained when the ANC is not executed are indicated by the broken curve, those obtained when the direct method is used are indicated by the one-dashed chain curve, and those obtained when the ANC method according to this embodiment is used are indicated by the solid curve. As can be seen from FIGS. 10A, 10B, and 10C, with the ANC method according to this embodiment, the control effects appear from an earlier stage than the direct method, and the control effects equivalent to those of the direct method can be obtained finally. Note that the reason no control effects appear in a frequency band of 500 Hz or higher is that the error signal passes through a low-pass filter of 500 Hz. As can be understood from these experimental results, the ANC method according to this embodiment reduces noise more efficiently than the direct method.

According to at least one of the embodiments described above, there is provided an active noise-reduction apparatus which can efficiently reduce noise.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An active noise-reduction apparatus comprising:

a reference signal generation unit configured to generate a plurality of reference signals based on first sound generated from a sound source;

a first filter processing unit configured to generate a plurality of first control signals by filtering the plurality of reference signals using a plurality of first digital filters;

an averaging unit configured to generate a second control signal by averaging the plurality of first control signals;

a control speaker configured to output the second control signal as second sound;

an error microphone configured to detect a synthetic sound pressure of the first sound and the second sound, and to generate an error signal indicating the detected synthetic sound pressure;

a plurality of second digital filters corresponding to spatial characteristics between the control speaker and the error microphone and configured to generate a plurality of estimated control signals based on the second control signal; and a filter update unit configured to update the plurality of first digital filters and the plurality of second digital filters so that a plurality of virtual error signals are minimized and the plurality of second digital filters converge on an identical digital filter, the plurality of virtual error signals being based on the error signal and the plurality of estimated control signals.

2. The apparatus according to claim 1, wherein the reference signal generation unit comprises a plurality of reference microphones, each of the plurality of reference microphones being configured to detect a sound pressure of the first sound to generate a detection signal as each of the plurality of reference signals.

3. The apparatus according to claim 2, further comprising:

a plurality of third digital filters corresponding to spatial characteristics between the plurality of reference microphones and the error microphone, wherein the plurality of virtual error signals are further based on a plurality of signals output by the plurality of third digital filters, the filter update unit updates the plurality of first digital filters, the plurality of second digital filters, and the plurality of third digital filters so that the plurality of virtual error signals are minimized and the plurality of second digital filters converge on an identical digital filter.

4. The apparatus according to claim 1, wherein the reference signal generation unit comprises a reference microphone configured to detect a sound pressure of the first sound to generate a detection signal, and a second filter processing unit configured to generate the plurality of reference signals by filtering the detection signal using a plurality of delay filters configured to delay the detection signal by different times.

5. The apparatus according to claim 4, further comprising:

a plurality of third digital filters corresponding to spatial characteristics between a plurality of reference microphones virtually generated by the second filter processing unit and the error microphone, wherein the plurality of virtual error signals are further based on a plurality of signals output by the plurality of third digital filters, the filter update unit updates the plurality of first digital filters, the plurality of second digital filters, and the plurality of third digital filters so that the plurality of virtual error signals are minimized and so that the plurality of second digital filters converge on an identical digital filter.

6. The apparatus according to claim 1, wherein the reference signal generation unit comprises a reference microphone configured to detect a sound pressure of the first sound to generate a detection signal, and a second filter processing unit configured to generate the plurality of reference signals by filtering the detection signal using a plurality of spatial characteristic filters.

7. The apparatus according to claim 6, further comprising:

a plurality of third digital filters corresponding to spatial characteristics between a plurality of reference microphones virtually generated by the second filter processing unit and the error microphone, wherein the plurality of virtual error signals are further based on a plurality of signals output by the plurality of third digital filters, the filter update unit updates the plurality of first digital filters, the plurality of second digital filters, and the plurality of third digital filters so that the plurality of virtual error signals are minimized and so that the plurality of second digital filters converge on an identical digital filter.

8. The apparatus according to claim 3, wherein the filter update unit updates the plurality of second digital filters based on an update rule which includes a parameter for adjusting priority levels of a degree of reduction of the plurality of virtual error signals and a degree of convergence of the plurality of second digital filters on an identical digital filter.

9. The apparatus according to claim 1, wherein the filter update unit updates the plurality of first digital filters so that a difference between each of the plurality of first control signals and the second control signal decreases.

* * * * *